US007542065B2

(12) United States Patent
Makino

(10) Patent No.: US 7,542,065 B2
(45) Date of Patent: Jun. 2, 2009

(54) LIGHT BEAM SCANNING APPARATUS AND CONTROLLING METHOD FOR IMAGE FORMING APPARATUS

(75) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 348 days.

(21) Appl. No.: 11/623,479

(22) Filed: Jan. 16, 2007

(65) Prior Publication Data

US 2007/0165101 A1 Jul. 19, 2007

(30) Foreign Application Priority Data

Jan. 16, 2006 (JP) ..... 2006-007922

(51) Int. Cl.
*B41J 2/44* (2006.01)

(52) U.S. Cl. ..... 347/261

(58) Field of Classification Search ..... 347/256–261
See application file for complete search history.

(56) References Cited

U.S. PATENT DOCUMENTS 6,839,078 B2 * 1/2005 Izumiya et al. ..... 347/249
7,079,781 B2 * 7/2006 Suzuki et al. ..... 399/45
2004/0047666 A1 * 3/2004 Imaizumi et al. ..... 400/76
2005/0007440 A1 * 1/2005 Nishikawa ..... 347/232
2005/0105924 A1 * 5/2005 Suzuki et al. ..... 399/45
2006/0158712 A1 * 7/2006 Higashi et al. ..... 359/216
2006/0274141 A1 * 12/2006 Park et al. ..... 347/118

FOREIGN PATENT DOCUMENTS

JP 2004-25841 A 1/2004

* cited by examiner

*Primary Examiner*—Huan H Tran
(74) *Attorney, Agent, or Firm*—Rossi, Kimms & McDowell, LLP

(57) ABSTRACT

A light beam scanning apparatus that causes a beam generated by a light source to scan corresponding to recording direction along a photosensitive medium by rotating polygonal mirrors, wherein to form a latent image on the photosensitive medium, comprising a first polygonal mirror that rotates at a first velocity, a second polygonal mirror that rotates at a second velocity different from the first velocity, and a controller that carries out image formation by selectively using the first polygonal mirror and the second polygonal mirror.

15 Claims, 13 Drawing Sheets

FIG. 5

ELONGATION PIXEL DATA TABLE

| | PAPER TYPE A | PAPER TYPE B | PAPER TYPE C | PAPER TYPE D |
|---|---|---|---|---|
| ELONGATION PIXEL NUMBER DATA (FRONT FACE) | 2 | 5 | 8 | 10 |
| ELONGATION PIXEL NUMBER DATA (BACK FACE) | 0 | 3 | 5 | 6 |

STANDARD PERIOD TABLE

| | PAPER TYPE A | PAPER TYPE B | PAPER TYPE C | PAPER TYPE D |
|---|---|---|---|---|
| BD SIGNAL STANDARD PERIOD (FRONT FACE) | 100.03% | 100.07% | 100.11% | 100.14% |
| BD SIGNAL STANDARD PERIOD (BACK FACE) | 100.00% | 100.04% | 100.07% | 100.08% |

LIGHT BEAM SCANNING APPARATUS AND CONTROLLING METHOD FOR IMAGE FORMING APPARATUS

BACKGROUND OF THE INVENTION

1. Field of the Invention

The present invention relates to light beam scanning apparatuses used in image forming apparatuses that use electrophotographic processes such as printers and copiers, and controlling methods for image forming apparatuses.

2. Description of the Related Art

In electrophotographic image forming apparatuses such as laser printers, a printing operation is carried out through the processes of exposure, development, transfer, and fixing. Specifically, first a beam (a laser beam for example) irradiated from a light source (a semiconductor laser for example) is modulated according to pixel unit image data (image signals). Next, an electrostatic latent image of an image to be printed is formed by the modulated beam being raster scanned onto a photosensitive drum surface by a multifaceted mirror (a rotating multifaceted mirror such as a polygonal mirror, also referred to as a deflector). The electrostatic latent image is developed as a toner image by a development apparatus. Next, the toner image is transferred to a transfer material (printing paper) by a transfer roller, and then fixed onto the transfer material by fixing heat from a fixing device, so that the toner image is formed as an image on the transfer material.

However, when fixing the toner image using heat, a portion of the water content contained in the transfer material is vaporized by the heat at the time of fixing so that the transfer material, which results in a change in dimension. The rate of shrinkage varies depending on the type and thickness of the transfer material, but is approximately 0.1 to 0.5% lengthwise. Transfer material that has shrunk due to fixing will subsequently reabsorb water content and expand to return to its original dimensions, but approximately 15 to 20 minutes are required to do this. An image that has been formed on the transfer material also undergoes a similar change in dimension due to shrinkage of the transfer material at the time of fixing and the subsequent expansion.

Consequently, in double sided printing mode in which images are formed on both sides of the transfer material, image formation is carried out on the back face (second side) in a state in which the transfer material has shrunk approximately 0.1 to 0.5% after an image has been transferred and fixed onto the front face (first side). Thus, after image formation on the back face, when the transfer material reabsorbs water content and expands to its original dimensions, the images expand and the image sizes of the front face and back face become different from each other, thereby causing a problem that registration of the front face and the back face (front to back registration) shifts out of position.

Accordingly, in order to address this problem in double sided printing mode, an image forming apparatus has been proposed having means for achieving high precision registration by matching the front and back image sizes for images to be outputted during double sided printing. For example, see Japanese Patent Laid-Open No. 2004-25841.

In the case of this image forming apparatus, the pixel length is constituted by a plurality of high frequency clocks in a high frequency clock generating device that generates from a basic clock a high frequency clock that is a multiple integer of the basic clock. Then, adjustments are carried out for main scanning direction shrinkage that occurs during front face image forming and back face image forming in double sided printing mode by reducing the number of high frequency clocks that constitute pixels whose pixel width is subjected to shrinkage. Furthermore, adjustments are carried out for sub scanning direction shrinkage by making the rotation rate of the deflector greater than that for front face image formation.

However, this method for adjusting sub scanning direction shrinkage in double sided printing by changing the rotation rate of the deflector has the following problems when attempting to reduce printing times and achieve higher productivity.

Namely, when changing the rotation rate of the deflector to match the sub scanning rate for the second side (back face) during double sided printing, the rotation rate of the deflector must be changed after completion of writing of the first side (front face). However, since the rotation rate of the deflector does not become stable until a predetermined setting time has passed after changing the rotation rate, the second side cannot be written until after the setting time of the deflector has passed (after a time in which the rotation rate of the deflector has stabilized). Thus, there is an impediment against achieving higher productivity in printing when attempting to reduce printing times and achieve higher productivity in printing by shortening the interval between the first side and the second side since the interval cannot be set shorter than the setting time.

SUMMARY OF THE INVENTION

The present invention provides for example a light beam scanning apparatus and a control method for an image forming apparatus that enable printing times to be shortened and high productivity to be achieved while forming high quality images in double sided printing and the like.

A light beam scanning apparatus according to one aspect of the present invention is a light beam scanning apparatus that causes a beam generated by a light source to scan corresponding to recording direction along a photosensitive medium by rotating polygonal mirrors, wherein to form a latent image on the photosensitive medium, comprising a first polygonal mirror that rotates at a first velocity, a second polygonal mirror that rotates at a second velocity different from the first velocity, and a controller that carries out image formation by selectively using the first polygonal mirror and the second polygonal mirror.

Another aspect of the present invention is a controlling method for an image forming apparatus having a light beam scanning apparatus that causes a beam generated by a light source to scan corresponding to recording direction along a photosensitive medium by rotating polygonal mirrors, wherein to form a latent image on the photosensitive medium, wherein the light beam scanning apparatus is provided with a first polygonal mirror that rotates at a first velocity, and a second polygonal mirror that rotates at a second velocity different from the first velocity, and the controlling method includes a first image forming step of forming an image using the first polygonal mirror, and a second image forming step of forming an image using the second polygonal mirror.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5 is a diagram for describing an example of an elongation pixel table and a standard period table.

DESCRIPTION OF THE EMBODIMENTS

First Embodiment

The following is a description of an image forming apparatus of the present embodiment with reference to the accompanying drawings.

[Characteristics]

An image forming apparatus according to the present embodiment carries out double sided printing on a printing medium using a laser scanner (light beam scanning apparatus) having two multifaceted mirrors (rotating multifaceted mirrors such as polygonal mirrors) that rotate at two different velocities in directions opposite to each other. Thus, a scanning beam can be achieved by deflecting the traveling direction of the beam using a first polygonal mirror that rotates at a first velocity when printing on a first side during double sided printing, and using a second polygonal mirror that rotates at a second velocity for adjusting shrinkage of the printing medium when printing on a second side (back face). In other words, the light beam scanning apparatus causes the beam generated by a light source to scan corresponding to a recording direction along a photosensitive drum (photosensitive medium) by rotating polygonal mirrors. As a result, it is unnecessary to have a standby time until the rotation velocity of the polygonal mirror becomes stable after printing on the first side as when using a conventional single polygonal mirror, and therefore printing times can be shortened while maintaining high quality.

Figure 1:
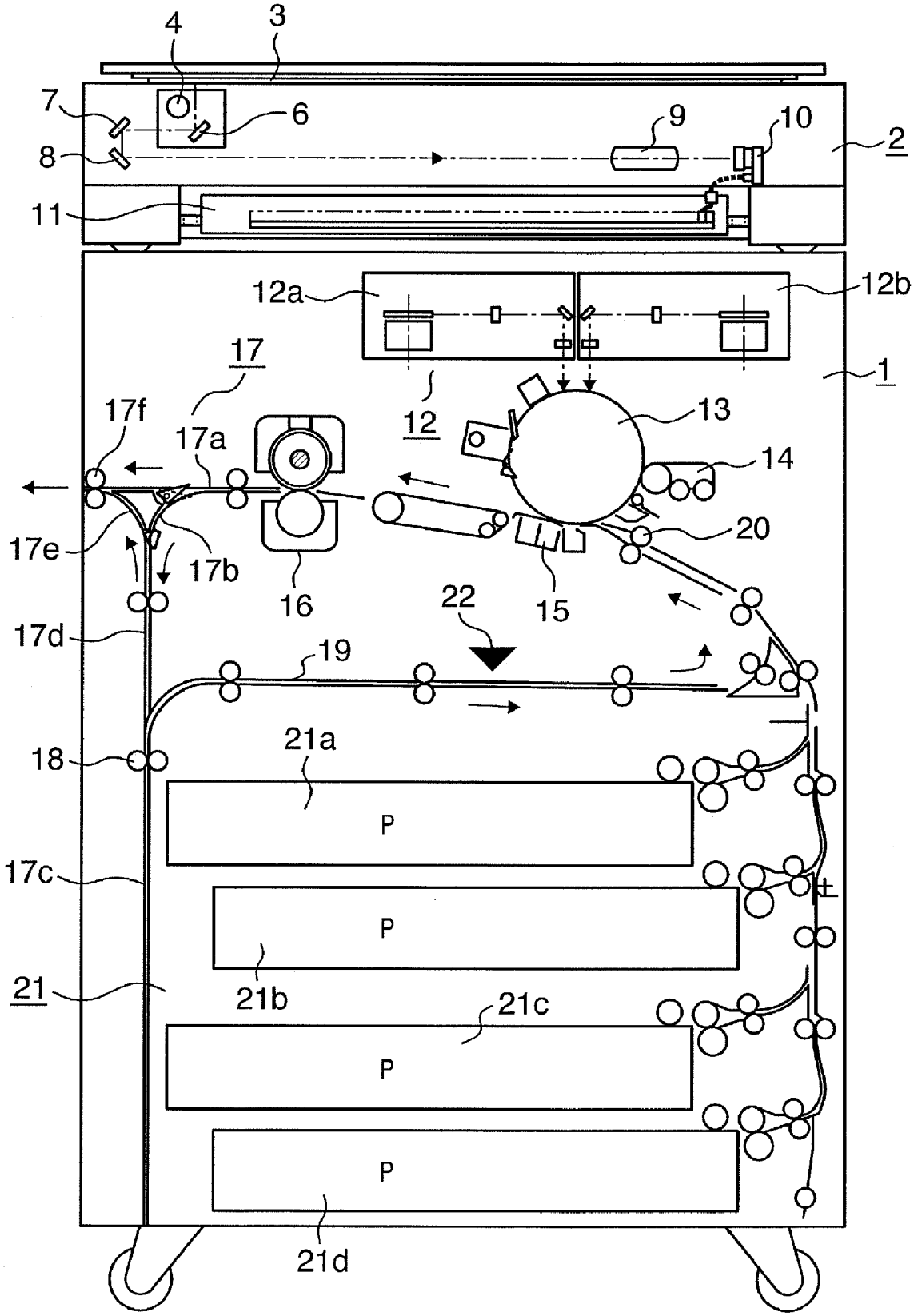
FIG. 1 is a vertical cross-sectional view that schematically shows a configuration of an image forming apparatus according to a first embodiment.

[Image Forming Apparatus: FIG. 1]

FIG. 1 is a vertical cross-sectional view that schematically shows a configuration of an image forming apparatus according to the present embodiment. The image forming apparatus is provided with a printer part 1, which is an image forming part, and a reader part 2, which is an image reading part.

First, a configuration of the reader part 2 is described. Numeral 3 indicates a platen glass for placing documents and numeral 4 indicates a lamp for irradiating a light onto a document surface. Numerals 6, 7, and 8 indicate mirrors, numeral 9 indicates a lens, numeral 10 indicates a CCD unit, and an image on the platen glass 3 is scanned by moving the lamp 4 and the mirror 6. Light reflected from the document is guided to the lens 9 by the mirrors 6, 7, and 8, focused onto the CCD unit 10 by the lens 9, and the CCD unit 10 reads the image information. Furthermore, numeral 11 indicates a controller, which processes image signals sent from the CCD unit 10, then sends these to an exposure part 12 of the printer part 1.

Next, the printer part 1 is described. Numerals 12*a* and 12*b* indicate laser scanners that are the exposure part, numeral 13 indicates a photosensitive drum, numeral 14 indicates a developing device, numeral 15 indicates a transferring-separating charger, numeral 16 indicates a fixing device, numeral 17 indicates a reversing paper discharge unit, numeral 21 (21*a*, 21*b*, 21*c*, and 21*d*) indicates cassettes, and character P indicates paper (a printing medium).

First, the laser scanners 12*a* and 12*b* irradiate laser lights based on image signals (pixel unit image data) sent from the controller 11, then expose and scan the photosensitive drum 13 using these laser lights. A latent image corresponding to these laser lights is formed on the photosensitive drum 13 due to this laser light exposure and scanning. The latent image formed on the photosensitive drum 13 is made visible (developed) as a toner image on the photosensitive drum 13 due to the supply of toner by the developing device 14. Furthermore, paper P is sent out from the cassettes 21*a*, 21*b*, 21*c*, and 21*d* with timings to match the latent image, and after registration correction is performed by registration rollers 20, the paper P is sent to the transferring-separating charger 15. At the transferring-separating charger 15, the toner image is transferred to the paper P, the paper P electrostatically adhering to the photosensitive drum 13 is separated therefrom, and the paper P is carried to the fixing device 16 by a carrying unit. At the fixing device 16, the toner image on the paper P is thermo-compressed and fixed onto the paper P.

The reversing paper discharge unit 17 has two paths for carrying the paper P when the image forming apparatus is used for single sided printing. The first path is a straight discharge path through which paper P that has passed through the fixing device 16 is discharged outside the apparatus by passing directly from a path 17*a* to a path 17*f*. The second path is a reversing discharge path through which paper P that has passed through the fixing device 16 is fed once in the order of paths 17*a*, 17*b*, 17*d*, and 17*c*, where it is switched back and fed in the order of the paths 17*c*, 17*d*, and 17*e* to be discharged outside the apparatus. By repeating the above-described series of processes, image formation is possible on a plurality of sheets using single sided printing.

Furthermore, when using the image forming apparatus for double sided printing, the first side is fed in the order of the paths 17*a*, 17*b*, 17*d*, and 17*c* after passing through the fixing device 16. At this time, a trailing edge of the paper P is fed in until sandwiched by reversing rollers 18, after which the reversing rollers 18 perform a switch back and the paper P is guided to a reverse route 19. The paper P that has been carried to the reverse route 19 has its registration corrected by the registration rollers 20 and is then sent to the transferring-separating charger 15 for an image to be formed on the second side, and is then discharged outside the apparatus via the straight discharge path. By repeating the above-described series of processes, image formation is possible on a plurality of sheets using double sided printing.

Figure 2A:
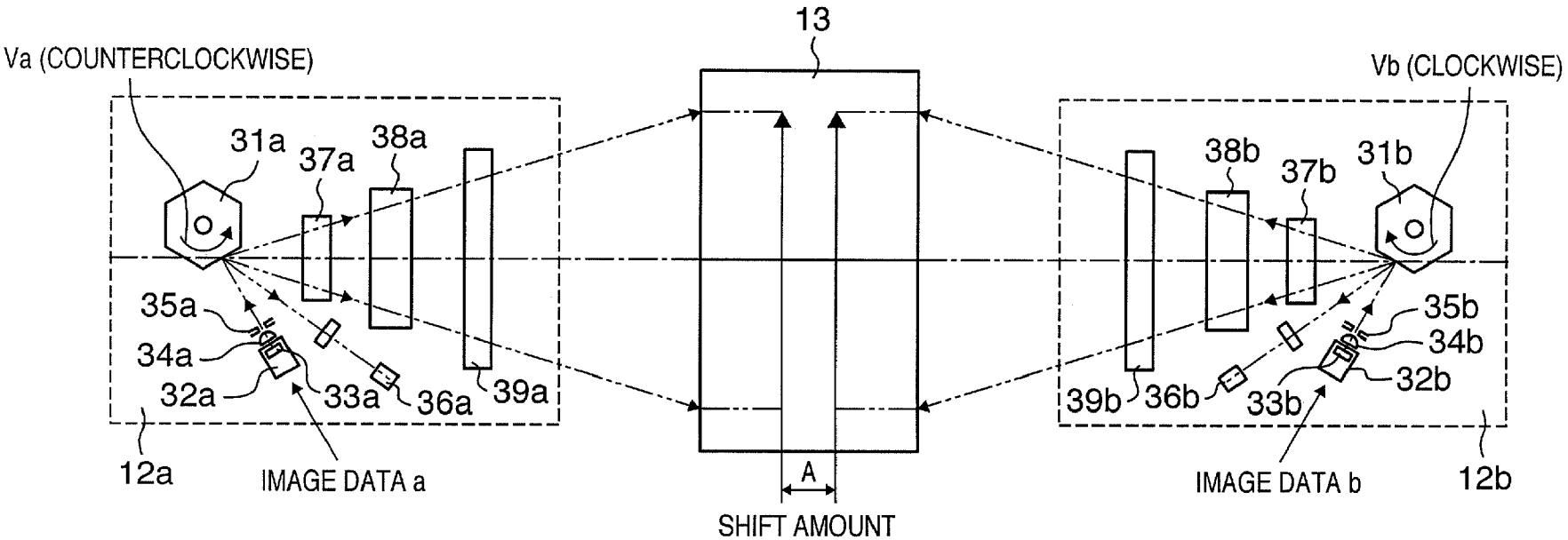
FIG. 2A illustrates a configuration of laser scanners, which are the exposure part of the first embodiment.

[Configuration of Laser Scanners: FIG. 2A]

FIG. 2A is a schematic top view of the laser scanners 12*a* and 12*b*, which are the exposure part of the image forming apparatus.

The laser scanners 12*a* and 12*b* of the present embodiment are a first laser scanner 12*a* and a second laser scanner 12*b* arranged symmetrically with respect to the photosensitive drum 13 as shown in FIG. 2A and perform scanning in the same direction as the drum surface. Accordingly, a polygonal mirror 31*b* of the second laser scanner 12*b* rotates in the direction opposite to the direction of a polygonal mirror 31*a* (rotating counterclockwise at an equal angular velocity Va) of the first laser scanner 12*a* and at a different velocity (rotating clockwise at an equal angular velocity Vb) from that of the first laser scanner 12*a*.

The following is a description of a configuration of the first laser scanner 12*a* only, but the configuration of the second laser scanner 12*b* is the same as the first laser scanner 12*a*.

Numeral 31*a* indicates a multifaceted mirror (a rotating multifaceted mirror such as a polygonal mirror (a deflector)), numeral 32*a* indicates a laser driving part, and numeral 33*a* indicates a semiconductor laser. A PD (photodiode) sensor (not shown) that detects a portion of laser light is arranged inside the semiconductor laser 33*a* and APC (auto power control) of the laser diode is conducted using a detection signal from the PD sensor.

The laser beam irradiated from the semiconductor laser 33*a* becomes a substantially parallel light due to a collimator lens 34*a* and a diaphragm 35*a*, and is incident on the polygonal mirror 31*a* with a predetermined beam diameter. The polygonal mirror 31*a* rotates in the direction shown by the arrow (counterclockwise) at the angular velocity Va and with this rotation the beam that is incident on the polygonal mirror 31*a* is reflected to become a deflected beam having a continuously changing angle.

The light that has become a deflected beam is focused by a first f-θ lens 37*a*, a tilt mirror 38*a*, and a second f-θ lens 39*a*. On the one hand, since distortion aberration correction is carried out with the f-θ lenses to ensure temporal linearity simultaneously during scanning, the beams are made to scan so as to create an image at a uniform velocity in the direction shown by the arrow in the drawing on the photosensitive drum 13, which acts as an image carrier. It should be noted that numeral 36*a* indicates a beam detection (hereinafter referred to as "BD") sensor that detects reflected light from the polygonal mirror 31*a*, and a detection signal of the BD sensor 36*a* is used as a synchronization signal for synchronizing the rotation of the polygonal mirror 31*a* and the writing of data.

It should also be noted that APC refers to control in which a drive current of the semiconductor laser is held at a single scanning period by detecting output of laser light at a light detection period during a single scan so as to keep constant the amount of laser light during a single scan. The semiconductor laser has temperature characteristics, and the amount of current for obtaining a constant amount of light increases for higher temperatures. Furthermore, since the laser is self-heating, it is not possible to obtain a constant amount of light by simply supplying a constant current and these factors have an important influence on image formation. Consequently, the amount of current that flows constantly in each scan is controlled using the APC in each scan such that the light emitting characteristics during each scan are constant. In this manner, a latent image can be formed on the photosensitive drum by turning OFF/ON the laser light that is controlled at a constant amount of light, according to image data that is modulated by an image processing circuit (not shown).

Thus, the image forming apparatus according to the present embodiment has the two laser scanners 12*a* and 12*b* that have different angular velocities, and therefore the laser scanners 12*a* and 12*b* can be switched for writing according to the use and application. For example, in the case of double sided printing, writing can be performed on the first side using the laser scanner 12*a* and on the second side using the laser scanner 12*b*. As a result, the image forming apparatus according to the present embodiment can commence scanning on the second side without waiting for the predetermined setting time from when the rotation rate of the polygonal mirror is changed until the rotation rate stabilizes as with a conventional image forming apparatus (having a single laser scanner). Consequently, the image forming apparatus of the present embodiment can improve productivity during double sided printing.

It should be noted that in the present embodiment, the laser scanning positions are shifted as shown in FIG. 2A, and therefore the timing for commencing writing with the second laser scanner 12*b* lags proportionally to the amount of shifting A on the photosensitive drum. However, to achieve even higher productivity, the laser scanning positions may be changed so as to scan at the same position, for example.

Figure 2B:
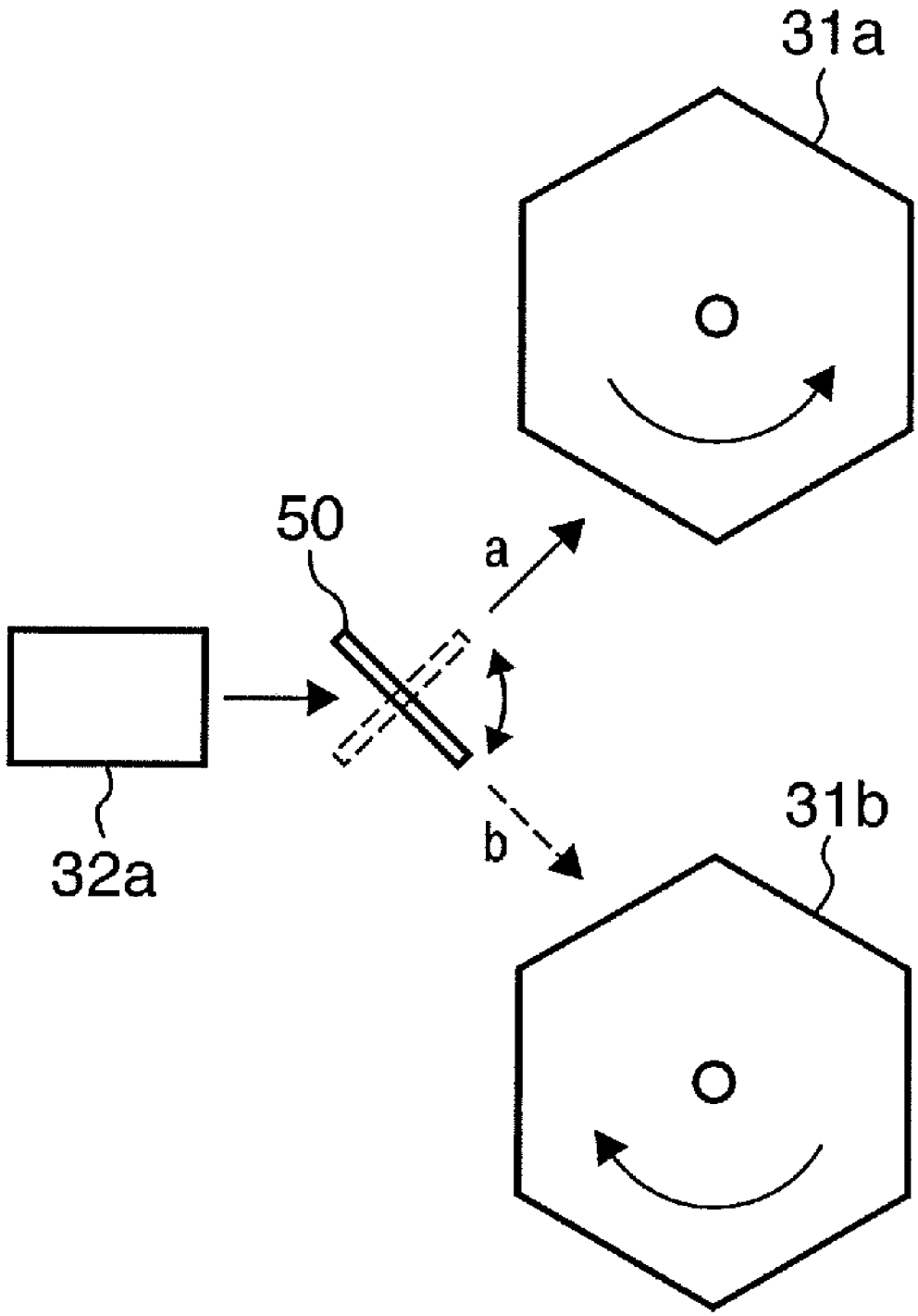
FIG. 2B illustrates a portion of a different configuration of the laser scanners.

[Portion of Different Configuration of Laser Scanners: FIG. 2B]

It should be noted that the above-described example using two laser scanners 12*a* and 12*b* (two laser driving parts) was one example, and it is also possible to arrange for example the two polygonal mirrors 31*a* and 31*b*, a deflecting mirror 50 that rotates, and a laser driving part 32*a* as shown in FIG. 2B. In this case, the laser light from the single laser driving part 32*a* can be irradiated onto the polygonal mirror 31*a* or the polygonal mirror 31*b* by rotating the deflecting mirror 50. As a result, two different scanning beams can be emitted from the two polygonal mirrors 31*a* and 31*b* in the same manner as when using two laser driving parts. It should be noted that in this case, the image data a and image data b shown in FIG. 2A may be used as the image data for driving the laser driving part 32*a*.

Figure 3:
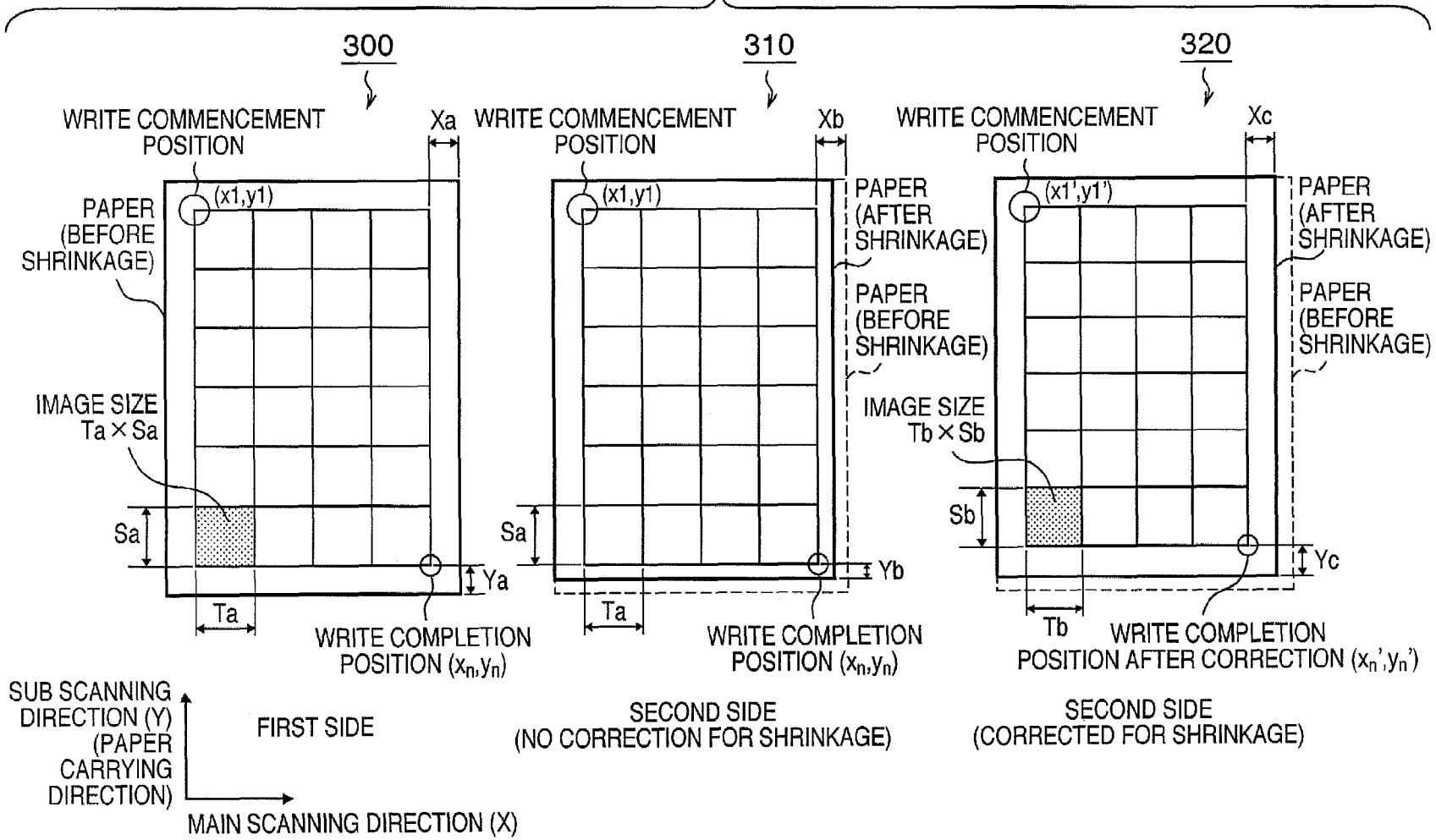
FIG. 3 is a diagram for describing image sizes and writing positions on a first side and a second side during double sided printing in the first embodiment.

[Laser Scanner Switching Operation During Double Sided Printing: FIG. 3]

FIG. 3 is used to describe a switching operation of the two laser scanners for first side printing (front face) and second side printing (back face) during double sided printing with the image forming apparatus according to the present embodiment.

Numeral 300 indicates the first side in double sided printing, and numeral 320 indicates the second side (that is corrected for shrinkage) in double sided printing. It should be noted that numeral 310 indicates a second side that is not corrected for shrinkage) in double sided printing, for the sake of comparison for describing characteristics of the image forming apparatus according to the present embodiment.

As described before, the image forming apparatus according to the present embodiment has the two laser scanners 12*a* and 12*b* and these are switched during double sided printing such that the first side is scanned by the first laser scanner 12*a* and the second side is scanned by the second laser scanner 12*b*.

Usually, water content in the paper is vaporized by the heat of the fixing device at the time of printing on the first side in double sided printing and the paper shrinks after fixing (by 0.1 to 0.5% for example). For this reason, image sizes Sa and Ta of images that are written without correcting to allow for this shrinkage during printing on the first side are equal on the first side and the second side as shown on 300 and 310. Consequently, a main scanning margin region Xa and a sub scanning margin region Ya positioned on the opposite side of the write commencement position (x1, y1) on the first side shown in 300 become smaller to Xb and Yb on the second side as shown in 310 due to shrinkage of the paper after fixing such that the image position shifts between the front face and the back face.

For this reason, in the present embodiment, in order to set the velocity of the second laser scanner 12*b* to be different from the velocity of the first laser scanner 12*a*, for example a paper type is set from an operation part (not shown), for example, set to A from paper types A, B, C, and D. In the image forming apparatus of the present embodiment, stored in advance in a storage part are an elongation pixel table corresponding to paper shrinkage and expansion, a standard period table, the number of clocks corresponding to the standard period table, and the rotation rates of the polygonal mirrors 31. Consequently, the number of clocks corresponding to the paper type that is set and the rotation rate of the polygonal mirrors 31 are set by being read out from the storage part based on the elongation pixel table and standard period table. As a result, when scanning the image (latent image) of the second side as shown in 320, the image sizes Sb and Tb can be scanned as images (latent images) that have been reduced by a portion corresponding to the shrinkage of the paper.

Furthermore, in the image forming apparatus of the present embodiment, the write commencement position (x1', y1') of the second side is also set as shown in 320 for the paper type that has been set so that scanning can commence from a position allowing the same margin as the first side giving consideration to paper shrinkage. As a result, margins Xc and Yc on the second side are equivalent to margins on the first side where the image has shrunk and front to back registration can be made to match with high accuracy.

[Adjusting Main Scanning Direction Shrinkage]

Next, a description is given concerning techniques for adjusting main scanning direction and sub scanning direction shrinkage when carrying out double sided printing using the above-described image forming apparatus.

First, a technique for adjusting main scanning direction shrinkage is described. With the image forming apparatus of the present embodiment, adjustments for main scanning direction shrinkage during double sided printing are carried out according to a technique described in Japanese Patent Laid-Open No. 2004-25841, and therefore the details are omitted and a simple description is given of the outline thereof.

In order to adjust main scanning direction shrinkage when forming a latent image on the second side (back face) during double sided printing, adjustments are carried out by reducing the number of high frequency clocks that constitute pixels whose pixel width is to be shrunk. Specifically, an elongation pixel table, in which presettings are made for each paper type as shown in FIG. 5, is stored in the storage part. Consequently, when paper type A is selected by the operation part (not shown) and image formation is to be carried out on the first side (front face) of the paper, "2" is set as the elongation pixel number data and therefore the number of pixels is increased by 2. On the other hand, when image formation is to be carried out on the second side (back face) of the paper, "0" is set as the elongation pixel number data and therefore the number of pixels is not increased. Next, the number of high frequency clocks that constitute pixels whose pixel width is to be shrunk is reduced based on the aforementioned settings. As a result, main scanning direction shrinkage during latent image formation on the second side (back face) in double sided printing can be adjusted.

Figure 4:
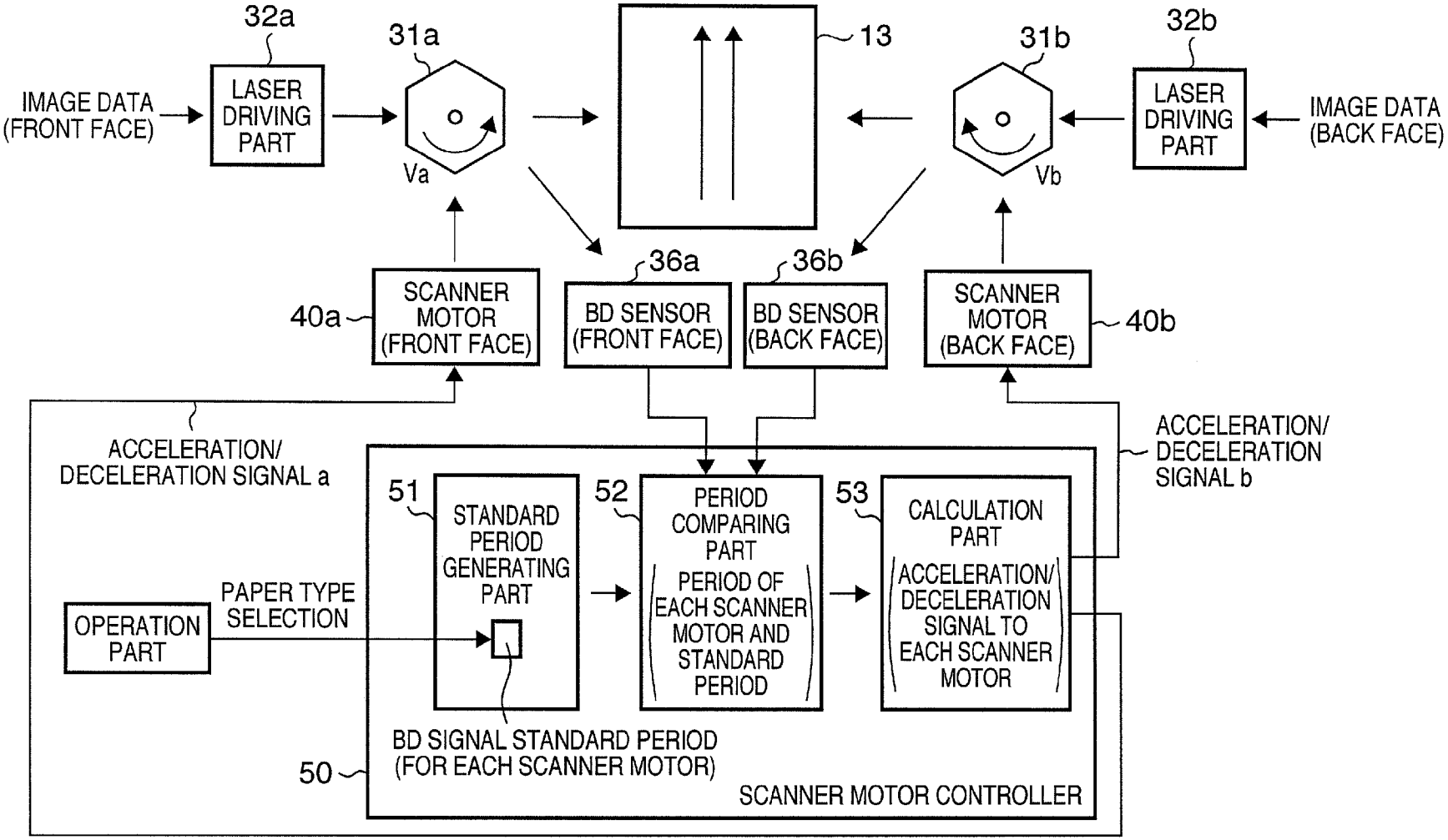
FIG. 4 is a diagram for describing control of the polygonal mirrors using a scanner motor controller according to the first embodiment.

[Adjusting Sub Scanning Direction Shrinkage (Polygonal Mirror Control): FIG. 4]

Next, a description is given based on FIG. 4 concerning techniques for adjusting sub scanning direction shrinkage using the polygonal mirrors 31*a* and 31*b* of different rotation velocities when carrying out double sided printing using the image forming apparatus having the two laser scanners 12*a* and 12*b*. It should be noted that a description is given of an operation of the polygonal mirror 31*a* in the description below, but the operation of the polygonal mirror 31*b* is basically the same as the operation of the polygonal mirror 31*a*.

The polygonal mirror 31*a* is rotated (counterclockwise) at a predetermined rotational velocity (Va) by a scanner motor 40*a*. In the operation of the scanner motor 40*a*, a period of the BD signal detected for each line by the BD sensor 36*a* is inputted to a period comparing part 52 in a scanner motor controller 50. On the other hand, when the paper type A selected by the operation part is inputted to a standard period generating part 51, a BD signal standard period corresponding to the paper type A is inputted to the period comparing part 52. The period comparing part 52 compares the period of the inputted BD signal and the standard period generated by the standard period generating part 51 and outputs a comparison result to a calculation part 53. The calculation part 53 outputs an acceleration/deceleration signal a to the scanner motor 40*a* so that the period of the BD signal reaches the target period. The scanner motor 40*a* performs control based on the acceleration/deceleration signal a so that the polygonal mirror 31*a* rotates stably. In this way, in the laser scanner 12*a*, the polygonal mirror 31*a* is controlled so as to rotate stably (counterclockwise) constantly at a set rotational velocity (Va). Similarly, also in the laser scanner 12*b*, the polygonal mirror 31*b* is controlled so as to rotate stably (clockwise) constantly at a set rotational velocity (Vb).

The standard period generating part 51 stores the standard period table shown in FIG. 5. Here for example the BD signal standard period for image formation on a paper type that does not shrink after the toner image is fixed is set to 100.00%, and paper type A is selected by the operation part.

In this case, the BD signal standard period (front face) of the paper type A in the standard period table shown in FIG. 5 is referenced when performing image formation on the front face (first side) of the paper (paper type A), and the BD signal standard period is set to 100.03%.

Following this, the BD signal standard period (back face) of the paper type A in the standard period table shown in FIG. 5 is referenced when performing image formation on the back face of the paper and the BD signal standard period is set to 100.00% for control of the scanner motor, and the image is formed. That is, elongation of the image in the sub scanning direction can be carried out by performing control of the scanner motor so that the target period for the BD signal is shortened and the rotational velocity of the rotating multifaceted body (polygonal mirror) becomes faster.

With the present embodiment, an example was described in which amounts of shrinkage (contraction) of paper is stored in advance as the standard period table. However, instead of presetting amounts of paper shrinkage, it is also possible to perform measurements by arranging a detection sensor 22 as shown in FIG. 1 such as a CCD sensor, a CIS sensor, or a reflectance type sensor for detecting the paper size in the reverse route 19 after the completion of fixing of the first side.

In this case, the clock number and rotation rate of the second laser scanner 12*b* can be determined in response to a measurement result of the amount of shrinkage of the paper, which is a detection result of the detection sensor 22.

Furthermore, in the present embodiment, scanning of the first side is conducted with a scanning magnification that is the same magnification as the image data and adjustments are carried out for the second side. However, it is also possible to slightly enlarge the first side and perform scanning giving consideration to shrinkage of the image Sa, Ta of the first side so that it becomes the same magnification after fixing. In this case, the second side can be scanned at the same magnification as the image data and it is possible to perform correction not only for registration accuracy but also for fluctuation in the magnification due to paper contraction.

Figure 6:
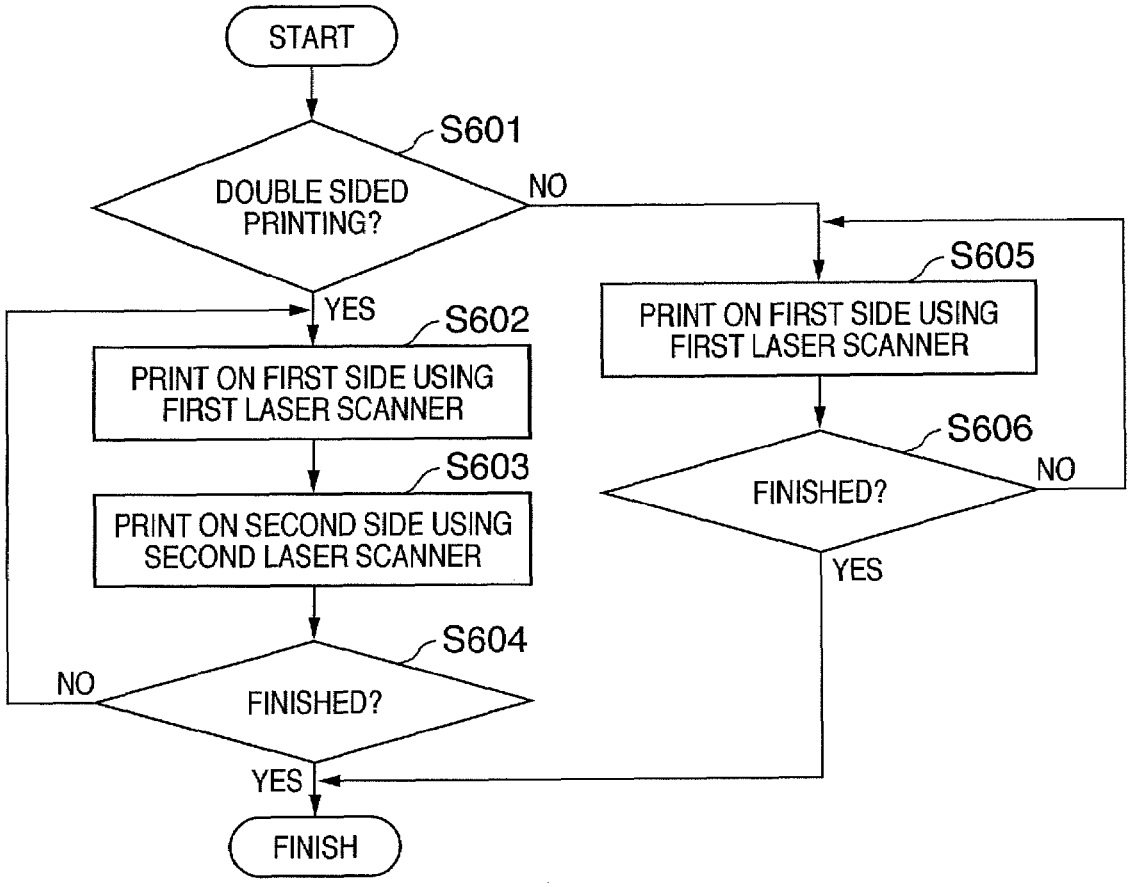
FIG. 6 is a flowchart for describing a printing process during double sided printing according to the first embodiment.

[Image Formation Processing: FIG. 6]

A description is given using FIG. 6 concerning image formation processing when performing double sided printing using the image forming apparatus of the present embodiment. The process of FIG. 6 is executed by a CPU (not shown) of the image forming apparatus according to a control program stored in a ROM (not shown) while performing control of each part using a RAM (not shown) as a work area.

First, when a print job is received, a determination is made at step S601 as to whether the print job is double sided printing or single sided printing, and when it is double sided printing the procedure proceeds to step S602.

At step S602, printing on the first side (front face) of the printing medium is controlled so as to be carried out using the above-described first laser scanner 12*a*. That is, a latent image is formed on the photosensitive drum using the polygonal mirror 31*a* and an image is formed by developing this latent image and transferring and fixing the toner image on the printing medium. Next, the procedure proceeds to step S603, where printing on the second side (back face) of the printing medium is controlled so as to be carried out using the above-described second laser scanner 12*b*. That is, a latent image is formed on the photosensitive drum using the polygonal mirror 31*b* and an image is formed by developing this latent image and transferring and fixing the toner image on the printing medium.

Next, the procedure proceeds to step S604, where a determination is made as to whether or not all the printing has been finished, and when all the printing has not been finished, the procedure returns to step S602 and the above-described processing continues. On the other hand, when all the printing has been finished at step S604, the series of operations is finished.

On the other hand, when the print job is single sided printing at step S601, the procedure proceeds to step S605. At step S605, printing on the first side (front face) of the printing medium is controlled so as to be carried out using the above-described first laser scanner 12*a*. That is, a latent image is formed on the photosensitive drum using the polygonal mirror 31*a* and an image is formed by developing this latent image and transferring and fixing the toner image on the printing medium.

Next, the procedure proceeds to step S606, where a determination is made as to whether or not all the printing has been finished, and when all the printing has not been finished, the procedure returns to step S605 and the above-described processing continues. When all the printing has been finished at step S606, the series of operations is finished.

Second Embodiment

Next, a description is given of an image forming apparatus according to a second embodiment. It should be noted that in the following description, description of portions in common with the first embodiment would be duplicated and therefore such description is omitted and only portions that are different are described.

[Characteristics]

Figure 9A:
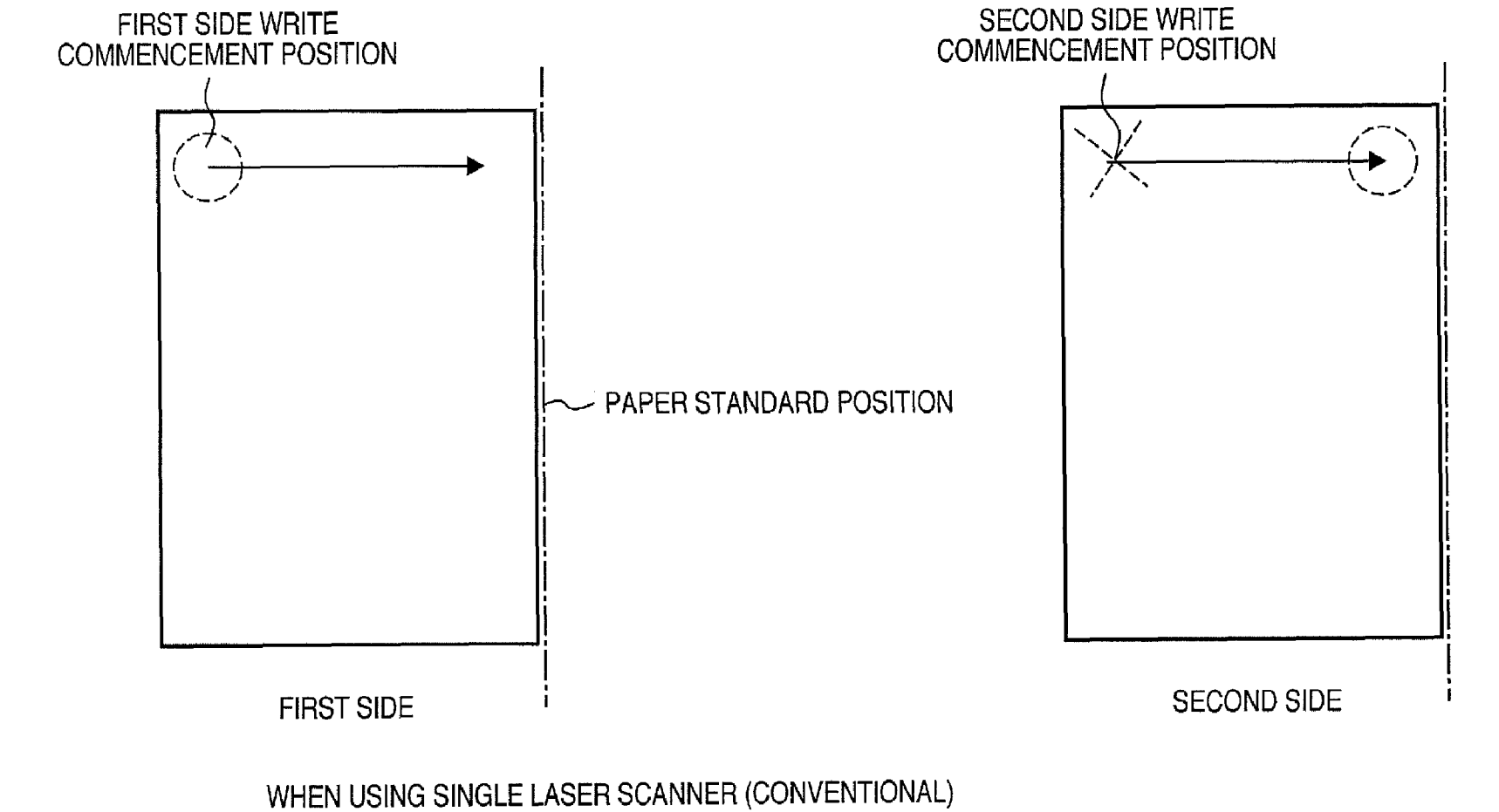
FIG. 9A is a diagram for describing a write commencement position on the first side and the write commencement position on the second side when using a single laser scanner.
Figure 9B:
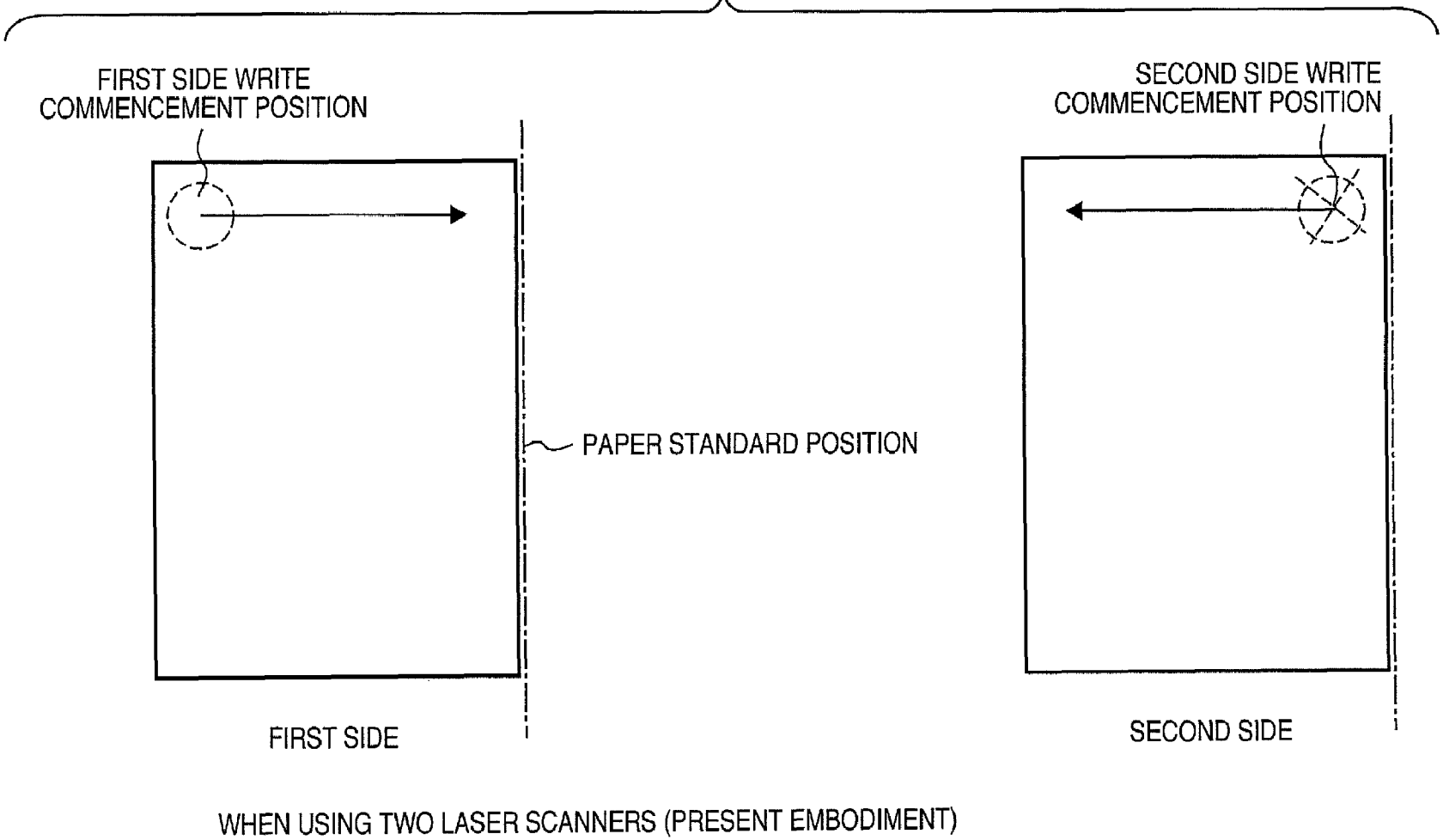
FIG. 9B is a diagram for describing a write commencement position on the first side and the write commencement position on the second side when using two laser scanners.

The image forming apparatus of the present embodiment differs from the image forming apparatus of the first embodiment in that the rotation directions of its polygonal mirrors (rotating multifaceted mirrors) are the same and the front and back of the paper are turned over and reversed while being carried during double sided printing. Thus, during double sided printing, a scanning beam can be used achieved by deflecting the traveling direction of the beam using a first polygonal mirror that rotates at a first velocity for the first side, and using a second polygonal mirror that rotates at a second velocity for the second side for adjusting shrinkage of the printing medium, in the same manner as the first embodiment. Moreover, by using two polygonal mirrors having the same rotation direction, the scanning direction on the photosensitive drum can be reversed for writing as shown in FIG. 9B. This makes it unnecessary to have a standby time until the rotational velocity of the polygonal mirror becomes stable after printing on the first side as when using a conventional single polygonal mirror. Furthermore, by having the front and back of the paper turned over to be reversed, the laser writing standard position can be set on opposing sides of the paper on the first side and the second side, and therefore unevenness in the writing standard due to unevenness in the size of the paper itself can be prevented. Consequently, printing times can be shortened while maintaining high quality.

Figure 7:
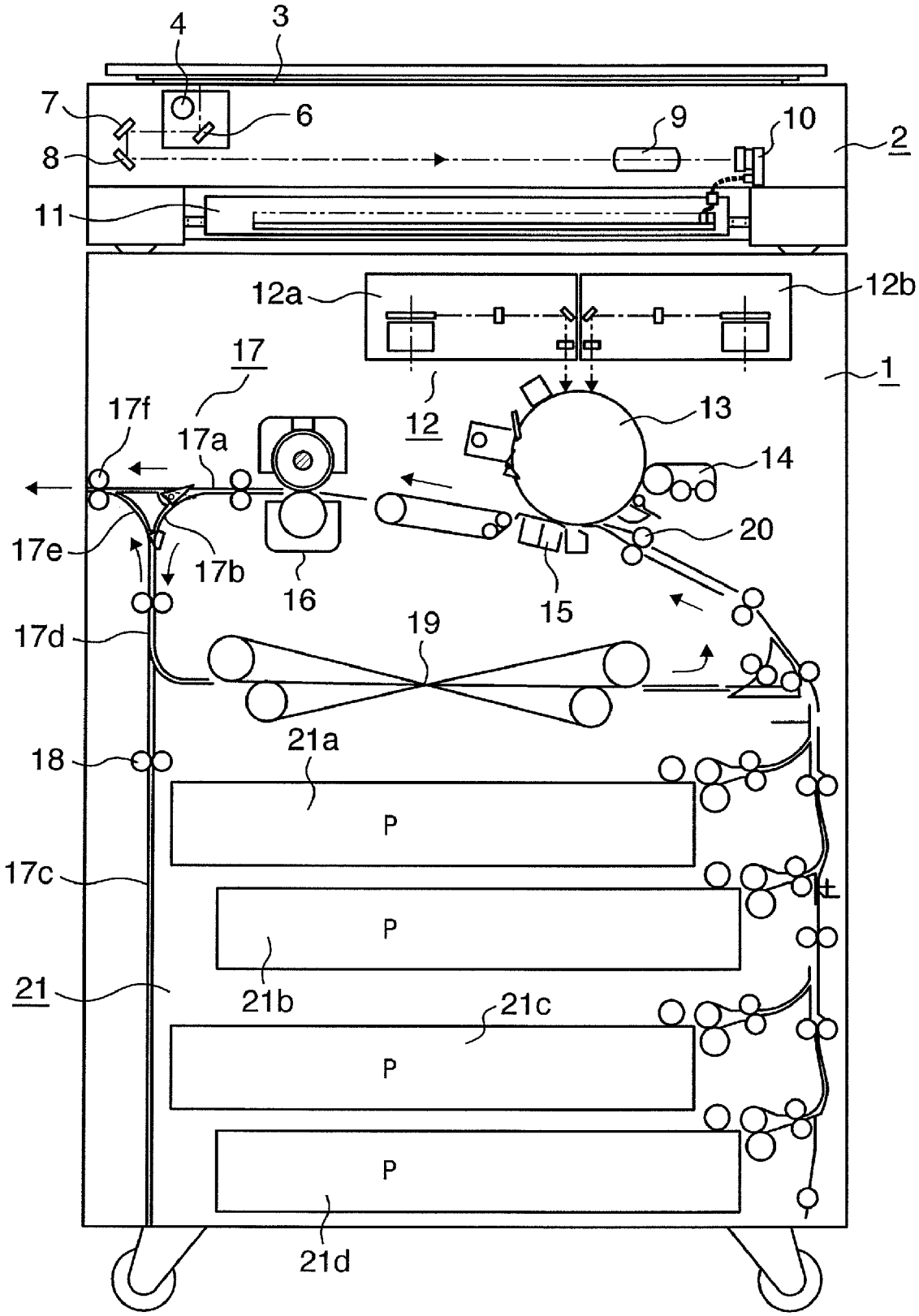
FIG. 7 is a vertical cross-sectional view that schematically shows a configuration of an image forming apparatus according to a second embodiment.

[Image Forming Apparatus: FIG. 7]

FIG. 7 is a vertical cross-sectional view that schematically shows a configuration of an image forming apparatus according to the present embodiment. The image forming apparatus is provided with a printer part 1, which is an image forming part, and a reader part 2, which is an image reading part.

In the image forming apparatus shown in FIG. 7, the reader part 2, the laser scanners 12*a* and 12*b*, the photosensitive drum 13, the developing device 14, the transferring-separating charger 15, the fixing device 16, the cassettes 21*a*, 21*b*, 21*c*, and 21*d*, and the paper P have the same configuration as those in the image forming apparatus of the first embodiment. Consequently, description of these is omitted.

A difference between the configuration of the image forming apparatus of the present embodiment and the configuration of the image forming apparatus of the first embodiment is the configuration from the reversing paper discharge unit 17 to the reverse route 19. As in the first embodiment, the reversing paper discharge unit 17 has two paths for carrying the paper P when the image forming apparatus is used for single sided printing. The first path is a straight discharge path through which the paper P that has passed through the fixing device 16 is discharged outside the apparatus passing from the path 17*a* to the path 17*f*. The second path is a reversing discharge path through which the paper P that has passed through the fixing device 16 is fed once in the order of the paths 17*a*, 17*b*, 17*d*, and 17*c*, where it is switched back and fed in the order of the paths 17*c*, 17*d*, and 17*e* to be discharged outside the apparatus. By repeating the above-described series of processes, image formation is possible on a plurality of sheets using single sided printing.

Furthermore, when using the image forming apparatus of the present embodiment for double sided printing, the first side is fed in the order of the paths 17*a*, 17*b*, and 17*d* after passing through the fixing device 16, then the paper P is guided as it is to the reverse route 19. The reverse route 19 has a turnover reversing structure disclosed in Japanese Patent Laid-Open No. 2002-20000 in which paper is carried while being turned in a direction perpendicular to a paper carrying direction by four variable guide rollers and two belts. Thus, the front and back of the paper are turned over in the reverse route 19 and has its registration corrected again by the registration rollers 20, then sent to the transferring-separating charger 15 for an image to be formed on the second side, and is then discharged outside the apparatus via the straight discharge path.

Furthermore, when correcting the position of the paper with the registration rollers 20, tilting of the leading edge side of the paper is corrected by the registration rollers 20 and a side position of the paper is detected by a side registration detection sensor (not shown). Then, the paper position of each paper is aligned by using the detected side position of the paper and moving sideways the registration rollers 20 to a paper standard position shown in FIG. 9B. By repeating the above-described series of processes, image formation is possible on a plurality of sheets using double sided printing.

Figure 8:
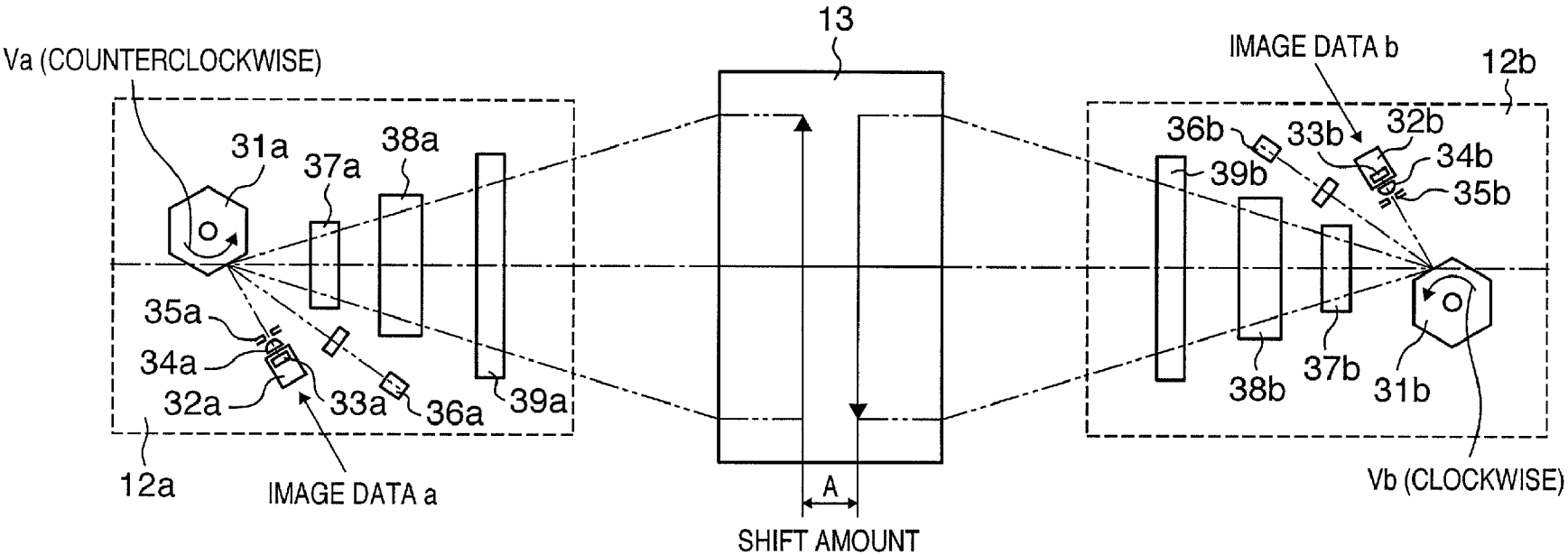
FIG. 8 illustrates a configuration of laser scanners, which are the exposure part of the second embodiment.

[Configuration of Laser Scanners: FIG. 8]

Next, a description is given of a configuration of the laser scanners 12*a* and 12*b* and a write commencement position during double sided printing according to the present embodiment with reference to FIGS. 8 to 9B.

FIG. 8 is a top view of the laser scanners 12*a* and 12*b*. FIGS. 9A and 9B show comparisons of the write commencement position on the first side and the write commencement position on the second side when using a conventional single laser scanner (FIG. 9A) and when using the two laser scanners 12*a* and 12*b* of the present embodiment (FIG. 9B).

As shown in FIG. 8, the laser scanner 12*a* of the present embodiment has the same configuration as the laser scanner 12*a* of the first embodiment. The laser scanner 12*b* of the present embodiment is arranged so as to face the configuration of the laser scanner 12*a* having the photosensitive drum 13 interposed therebetween, and is configured to carry out scanning from the opposite direction as the photosensitive drum 13. Consequently, the polygonal mirror 31*b* of the second laser scanner 12*b* is configured so as to rotate in the same direction as the polygonal mirror 31*a* of the first laser scanner 12*a*. With this configuration, an operation can be carried out to adjust shrinkage and expansion of the paper after the first side has passed through the fixing device as in the first embodiment. Furthermore, with this configuration, the laser writing standard position is set on opposing sides of the paper on the first side and the second side by the turnover reversing shown in FIGS. 9A and 9B, and therefore unevenness in the writing standard due to unevenness in the size of the paper itself can be prevented.

In this manner, the image forming apparatus according to the present embodiment carries out writing from opposite directions on the photosensitive drum 13 using the laser scanners 12*a* and 12*b* that have two different rotation velocities. This enables the image forming apparatus of the present embodiment to have improved productivity (shorter printing times) in double sided printing as in the first embodiment. Moreover, an effect is also obtained whereby the writing standard of the first side and the writing standard of the second side are aligned using the same edge portion of the paper such that there is no influence of paper size unevenness at the time of turnover reversing.

Furthermore, since either the near or far side of the paper can be selected as the writing standard in single sided printing, a user can freely select the edge desired for alignment.

Furthermore, in the present embodiment also the laser scanning positions are shifted and the timing for commencing writing with the second laser scanner 12*b* lags proportionally to an amount of shifting A on the photosensitive drum, but scanning may be performed at the same position to achieve even higher productivity.

Third Embodiment

Next, a description is given of an image forming apparatus according to a third embodiment. It should be noted that the image forming apparatus of the present embodiment has the same configuration as the image forming apparatus of the first embodiment shown in FIGS. 1 to 2B, and therefore description of portions in common would be duplicated and so such description is omitted and only portions that are different are described in the following description.

[Characteristics]

An image forming apparatus according to the present embodiment forms images of different resolutions using laser scanners having polygonal mirrors (rotating multifaceted mirrors) that rotate at two different velocities in directions opposite to each other. For example, when forming an image using image data containing a character area and an image area, the character area is printed at a high resolution (first laser scanner) and the image area, which does not require a resolution as high as for characters, is printed at a low resolution (second laser scanner). As a result, the image forming apparatus of the present embodiment can form images with high quality and high productivity.

Figure 10:
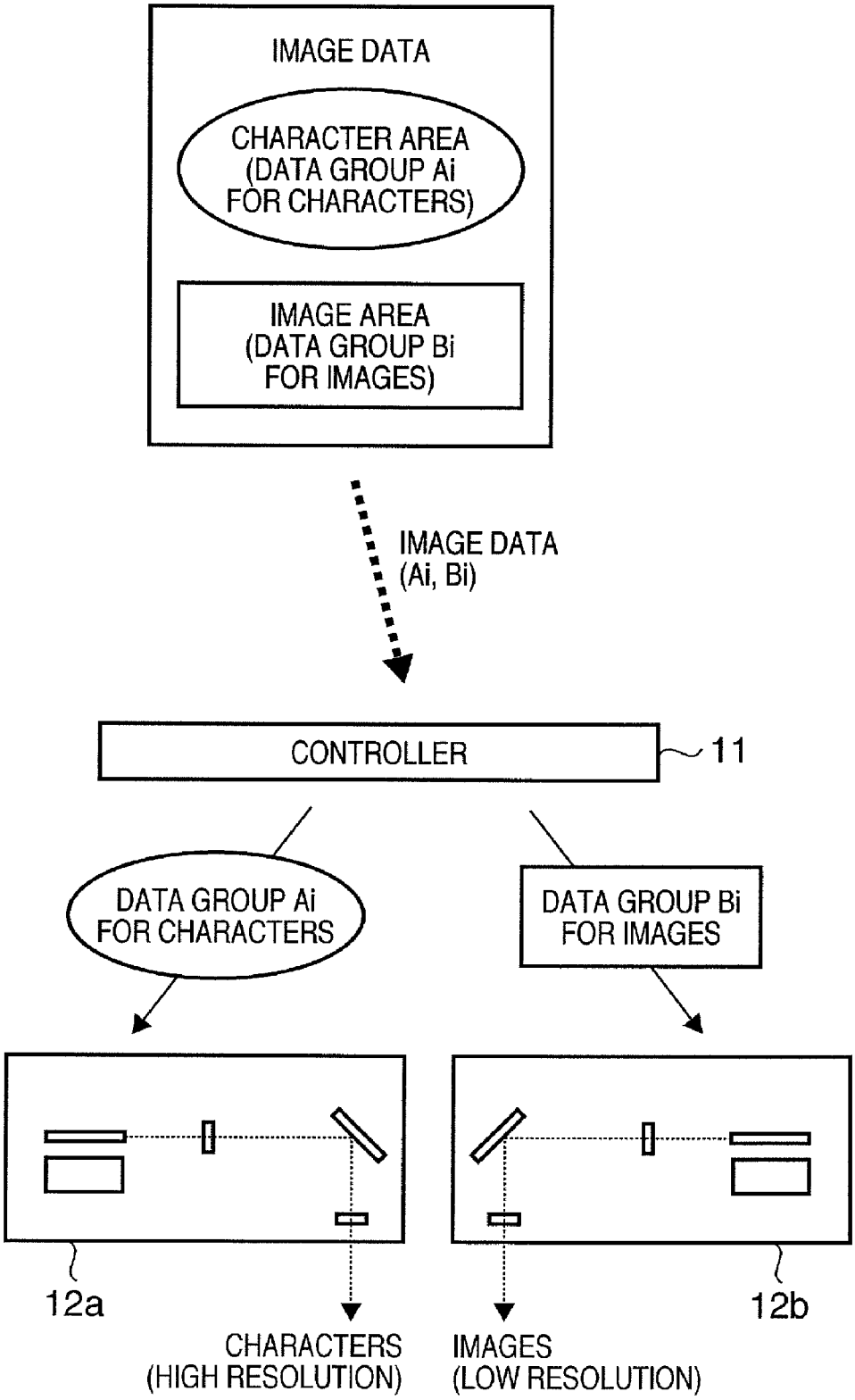
FIG. 10 is a conceptual diagram for describing an operation of forming a latent image having a character area and an image area using two laser scanners in single sided printing with an image forming apparatus according to a third embodiment.

[Laser Scanner Switching Operation for Character Areas and Image Areas: FIG. 10]

FIG. 10 is a conceptual diagram for describing an operation in which an image is formed using two laser scanners in single sided printing from image data having a character area (data group Ai for characters) and an image area (data group Bi for images).

In the present embodiment, the first laser scanner 12*a* is used as a high resolution laser scanner only for character areas and the second laser scanner 12*b* is simultaneously used as a laser scanner only for images and has a lower resolution than the first laser scanner 12*a*. That is, the rotational velocity (Va) of the polygonal mirror 31*a* of the first laser scanner 12*a* is set faster than the rotational velocity (Vb) of the polygonal mirror 31*b* of the second laser scanner 12*b*.

The controller 11 identifies the character areas (data group Ai for characters) and the image areas (data group Bi for images) from the image data that is inputted and sends those sets of image data (the data group Ai for characters and the data group Bi for images) to the laser scanners 12. Next, based on the image data from the controller 11, the laser scanners 12*a* and 12*b* form a latent image on the photosensitive drum 13 for the same page by simultaneously scanning the character areas with the first laser scanner 12*a* and the image areas with the second laser scanner 12*b*.

With the above-described operation, higher quality of characters can be achieved by performing writing at a high resolution in the character areas, and writing can be performed at a low resolution in the image areas, so that the image processing load on the controller 11 can be reduced. As a result, high quality and high productivity can be achieved without being affected by waiting times for processing by the controller 11.

It should be noted that in the present embodiment, the laser scanning positions are shifted (FIG. 2A) and therefore the timing for commencing writing with the second laser scanner 12*b* lags proportionally to an amount of shifting A on the photosensitive drum 13, but control becomes easy by scanning at the same position.

Figure 11:
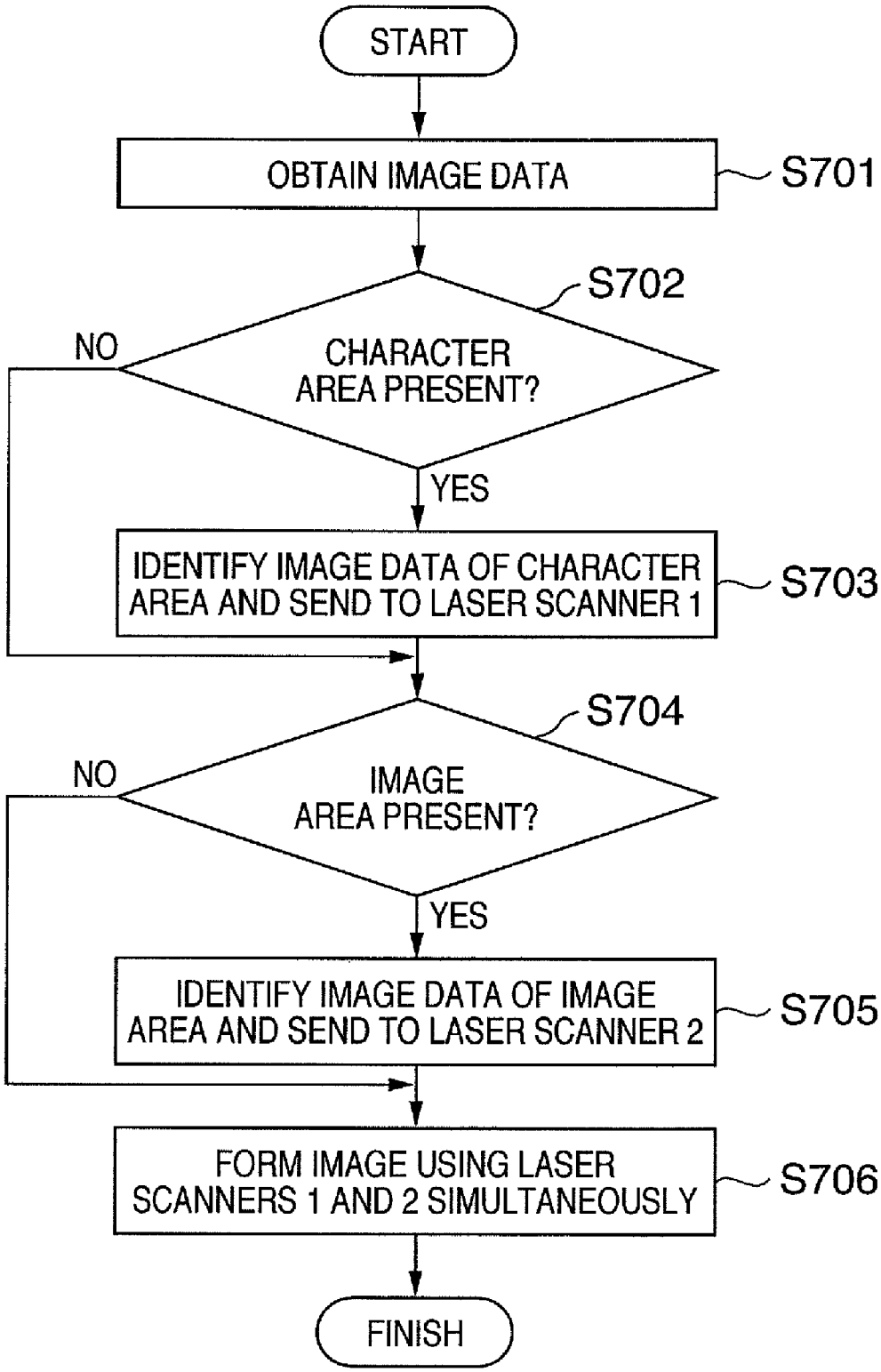
FIG. 11 is a flowchart for describing a process of forming an image with character areas at high resolution and image areas at low resolution in the third embodiment.

[Image Formation Processing: FIG. 11]

Description is given using FIG. 11 concerning image formation processing when performing single sided printing using the image forming apparatus of the present embodiment with character areas at high resolution and image areas at low resolution, based on image data containing the character areas and the image areas.

The process shown in FIG. 11 is executed by a CPU (not shown) of the image forming apparatus according to a control program stored in a ROM (not shown) while performing control of each part using a RAM (not shown) as a work area.

First, when image data is received at step S701, the procedure proceeds to step S702, where a determination is made as to whether or not a character area, that is, the data group Ai for characters for printing at high resolution, is present in the image data. When character area data is present, the procedure proceeds to step S703, where the data group Ai for characters is identified from the image data and the identified data group Ai is sent to the laser scanner 12*a*, and then the procedure proceeds to step S704. On the other hand, when there is no character area data at step S702, the procedure proceeds to step S704.

Next, at step S704, a determination is made as to whether or not an image area, that is, the data group Bi for images for printing at a low resolution, is present in the image data. When image area data is present, the procedure proceeds to step S705, where the data group Bi for images is identified from the image data and the identified data group Bi is sent to the laser scanner 12*b*, and then the procedure proceeds to step S706. On the other hand, when there is no image area data at step S704, the procedure proceeds to step S706.

Next, at step S706, printing on the character area is carried out at a high resolution using the laser scanner 12*a* (polygonal mirror 31*a*) and the image area is simultaneously scanned at a low resolution using the laser scanner 12*b* (polygonal mirror 31*b*) to form a latent image on the photosensitive drum. After this, the latent image is developed and a toner image is transferred to the printing medium and fixed thereon, and after the image is formed, the series of operations is finished.

As described above, with the present invention, a beam scanning apparatus used in an image forming apparatus and a control method for an image forming apparatus can be provided that enable printing times to be shortened and high productivity to be achieved while forming high quality images in double sided printing for example.

Other Embodiments

Furthermore, the object of the present invention may be to realized as a system or a device provided with a storage medium storing a program code of software that achieves the functionality of these embodiments. In these cases, a computer (or a CPU or MPU or the like) of the system or device may accomplish this by reading out and executing the program code stored on the storage medium.

In this case, the actual program code that is read out from the storage medium achieves the functionality of the above-described embodiments, such that the program code and the storage medium storing the program code constitute the present invention.

Furthermore, examples of storage media that can be used for providing the program code include a floppy disk, a hard disk, a magneto-optical disk, a CD-ROM, a CD-R, and a CD-RW. Also, a DVD-ROM, a DVD-RAM, a DVD-RW, a DVD+RW, a magnetic tape, a nonvolatile memory card, and a ROM or the like can be used. Moreover, the program code may be downloaded via a network.

Furthermore, the functionality of the foregoing embodiments is achieved by having a computer execute the program code that has been read out. However, in addition to this, this may also include having an OS (operating system) or the like that runs on a computer carry out a part or all of the actual processing according to instructions of the program code such that the functionality of the foregoing embodiments is achieved by the processing thereof.

Further still, it is possible for the program code read out from the storage medium to be written onto a memory provided in an extension board inserted into the computer or an extension unit connected to the computer. Subsequently, this may also include having a CPU or the like provided in the extension board or extension unit carry out a part or all of the actual processing according to instructions of the program code such that the functionality of the foregoing embodiments is achieved by the processing thereof.

Furthermore, the functionality of each of the above-described embodiments is achieved by having a computer execute the program code that has been read out. In addition to this, it will be understood that the present invention includes having an OS or the like that runs on a computer carry out a part or all of the actual processing according to instructions of the program code such that the functionality of each of the above-described embodiments is achieved by the processing thereof.

In this case, the program can be supplied directly from the storage medium storing the program, or downloaded from an other computer or database or the like (not shown) connected to the Internet, a business network, or a local area network or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese application No. 2006-007922 filed on Jan. 16, 2006, which is hereby incorporated by reference herein in its entirety.

What is claimed is:

1. A light beam scanning apparatus that scans a light beam generated by a light source on a photosensitive medium by rotating polygonal mirrors, wherein to form a latent image on the photosensitive medium, comprising:

a first polygonal mirror that rotates at a first velocity;

a second polygonal mirror that rotates at a second velocity different from the first velocity; and a controller that carries out image formation by selectively using the first polygonal mirror and the second polygonal mirror.

2. The light beam scanning apparatus according to claim 1, wherein when images are to be formed on both sides of a printing medium by developing the latent image, the controller uses the first polygonal mirror for forming the latent image for a first side and uses the second polygonal mirror for forming the latent image for a second side.

3. The light beam scanning apparatus according to claim 2, wherein a rotational velocity of the second polygonal mirror is faster than a rotational velocity of the first polygonal mirror.

4. The light beam scanning apparatus according to claim 3, wherein the first polygonal mirror and the second polygonal mirror rotate in the same direction.

5. The light beam scanning apparatus according to claim 3, wherein the first polygonal mirror and the second polygonal mirror rotate in directions opposite to each other.

6. The light beam scanning apparatus according to claim 1, wherein the controller uses the first polygonal mirror for forming a latent image at a first resolution and uses the second polygonal mirror for forming a latent image at a second resolution different from the first resolution.

7. The light beam scanning apparatus according to claim 1, further comprising:

a light source that generates a beam in response to image data; and a direction changing part that changes a direction of the beam so that the beam is made incident on the first polygonal mirror when image formation is to be carried out using the first polygonal mirror and the beam is made incident on the second polygonal mirror when image formation is to be carried out using the second polygonal mirror.

8. The light beam scanning apparatus according to claim 7, wherein the first polygonal mirror and the second polygonal mirror rotate in the same direction.

9. The light beam scanning apparatus according to claim 7, wherein the first polygonal mirror and the second polygonal mirror rotate in directions opposite to each other.

10. The light beam scanning apparatus according to claim 2, wherein a rotational velocity of the first polygonal mirror and a rotational velocity of the second polygonal mirror are determined based on information stored in advance in a storage part for each type of printing media.

11. The light beam scanning apparatus according to claim 2, further comprising:

a detector that detects a size of the printing medium, the latent image having been developed then transferred and fixed to a surface of the printing medium; and an adjustment part that adjusts a rotational velocity of the second polygonal mirror based on a detection result of the detector.

12. The light beam scanning apparatus according to claim 1, further comprising:

a segregating part that segregates image data to be used for forming the image into a first data group by which a character is formed and a second data group by which an image is formed, wherein the controller uses the second polygonal mirror when forming a latent image for a character using the first data group and uses the first polygonal mirror when forming a latent image for an image using the second data group.

13. A controlling method for an image forming apparatus having a light beam scanning apparatus that causes a beam generated by a light source to scan corresponding to recording direction along a photosensitive medium by rotating polygonal mirrors, wherein to form a latent image on the photosensitive medium, wherein the light beam scanning apparatus comprises a first polygonal mirror that rotates at a first velocity, and a second polygonal mirror that rotates at a second velocity different from the first velocity, and the controlling method comprises:

a first image forming step of forming an image using the first polygonal mirror; and a second image forming step of forming an image using the second polygonal mirror.

14. The controlling method for an image forming apparatus according to claim 13, wherein when images are to be formed on both sides of a printing medium by developing the latent images, the first polygonal mirror is used for forming the latent image for a first side in the first image forming step and the second polygonal mirror is used for forming the latent image for a second side in the second image forming step.

15. The controlling method for an image forming apparatus according to claim 13, wherein a rotational velocity of the second polygonal mirror is faster than a rotational velocity of the first polygonal mirror, further comprising a segregating step of segregating image data to be used for forming the image into a first data group by which a character is formed and a second data group by which an image is formed, wherein a latent image for a character is formed based on the first data group using the second polygonal mirror in the second image forming step and a latent image for an image is formed based on the second data group using the first polygonal mirror in the first image forming step.

* * * * *